US008243009B2

(12) United States Patent
Nishinosono

(10) Patent No.: US 8,243,009 B2
(45) Date of Patent: Aug. 14, 2012

(54) SEPARATELY-EXCITED INVERTER CIRCUIT AND LIQUID CRYSTAL TELEVISION

(75) Inventor: Kazuo Nishinosono, Osaka (JP)

(73) Assignee: Funai Electric Co., Ltd., Daito-shi, Osaka (JP)

( * ) Notice: Subject to any disclaimer, the term of this patent is extended or adjusted under 35 U.S.C. 154(b) by 1143 days.

(21) Appl. No.: 12/150,358

(22) Filed: Apr. 28, 2008

(65) Prior Publication Data

US 2008/0273125 A1 Nov. 6, 2008

(30) Foreign Application Priority Data

May 1, 2007 (JP) ..... 2007-120712

(51) Int. Cl.
*G09G 3/36* (2006.01)

(52) U.S. Cl. ..... 345/102; 315/312

(58) Field of Classification Search ..... 345/102; 315/312

See application file for complete search history.

(56) References Cited

U.S. PATENT DOCUMENTS

| | | | | |
|---|---|---|---|---|
| 5,384,518 | A * | 1/1995 | Kido et al. | 315/225 |
| 5,736,973 | A * | 4/1998 | Godfrey et al. | 345/102 |
| 5,818,669 | A * | 10/1998 | Mader | 361/18 |
| 2003/0214773 | A1* | 11/2003 | Kitagawa | 361/118 |
| 2003/0222601 | A1* | 12/2003 | Yamamoto et al. | 315/291 |
| 2005/0275031 | A1* | 12/2005 | Dournelle et al. | 257/355 |
| 2006/0077000 | A1* | 4/2006 | Goudo | 327/434 |
| 2006/0181227 | A1* | 8/2006 | Lu | 315/312 |
| 2008/0054816 | A1* | 3/2008 | Shackle et al. | 315/209 R |
| 2008/0205093 | A1* | 8/2008 | Davies et al. | 363/35 |

FOREIGN PATENT DOCUMENTS

| | | |
|---|---|---|
| JP | 2002-313592 | 10/2002 |
| JP | 2006-120515 | 5/2006 |

* cited by examiner

*Primary Examiner* — Alexander Eisen
*Assistant Examiner* — Viet Pham
(74) *Attorney, Agent, or Firm* — Yokoi & Co., U.S.A., Inc.; Toshiyuki Yokoi

(57) ABSTRACT

The separately-excited inverter circuit for performing the protecting operation upon the rise in the output voltage caused by the contact failure includes a switching circuit 26*b* which applies the AC to a primary coil of a pressure-rising transformer 26*e*, a control circuit C1 which starts a switch control of the switching circuit 26*b* upon an input of a command signal to set an oscillation state ON from a transmission line for the command signal to command to set the oscillation state ON and OFF, an output voltage monitor circuit 51 which allows a comparator 51*a* to compare an output voltage of the separately-excited inverter circuit with a predetermined voltage, and to output a predetermined reference voltage when the output voltage is higher than the predetermined voltage, and a thyristor circuit 52 which is turned ON to set the transmission line of the command signal into an oscillation OFF state upon the input of the reference voltage to the gate to stop a switch control of the control circuit C1. The output voltage monitor circuit 51 outputs the reference voltage to make a time width sufficient to turn the thyristor circuit 52 ON using a hysteresis of the comparator 51*a*.

5 Claims, 5 Drawing Sheets

SEPARATELY-EXCITED INVERTER CIRCUIT AND LIQUID CRYSTAL TELEVISION

CROSS-REFERENCES TO RELATED APPLICATIONS

The present application is related to the Japanese Patent Application No. 2007-120712, filed May 1, 2007, the entire disclosure of which is expressly incorporated by reference herein.

BACKGROUND OF THE INVENTION

1. Field of the Invention

The present invention relates to a separately-excited inverter circuit and a liquid crystal television, and more particularly, to a separately-excited inverter circuit for converting the input DC voltage into the AC voltage by the separately excited switching circuit so as to be output, and a liquid crystal television with the separately-excited inverter circuit.

2. Description of the Related Art

Generally, a solder portion of a circuit substrate is likely to get into trouble owing to the contact failure caused by the oscillation during the transportation, the drop impact, loosening or peeling off as passage of time and the like. The use of the circuit substrate in the aforementioned state with the contact failure may cause the noise waveform in the signal transferred through the circuit. Especially in the secondary side of the inverter circuit where the high voltage signal is transferred therein, the contact failure may impose the undesirable effect.

Generally, in the known process for coping with the trouble in the circuit, the noise waveform generated in the circuit is detected by the transistor, the operational amplifier, and the comparator, and the detection result is input to the microcomputer for executing the program to perform the protective function. The aforementioned protective function is structured not to detect the noise waveform with the short time width for the purpose of preventing the malfunction. It is therefore difficult to detect the noise waveform momentarily caused by the contact failure.

The technology for detecting the trouble in the circuit is disclosed in Japanese Unexamined Patent Application Publication No. 2006-120515. The document discloses that in the full-bridge type separately-excited inverter circuit, the frequency signal generated between the full-bridge and the pressure-rising transformer is detected, and when the detected frequency signal deviates from the preliminarily stored reference frequency or from the reference frequency range, the power supply to the separately-excited inverter circuit is interrupted.

Japanese Unexamined Patent Application Publication No. 2002-313592 discloses that a plurality of avalanche diodes are connected in series in the section where the predetermined potential difference is expected to occur, and when the potential difference becomes higher than the predetermined value, the avalanche diode breaks to protect the circuit.

Each art disclosed in Japanese Unexamined Patent Application Publication Nos. 2006-120515 and 2002-313592 is not intended to protect the circuit by detecting the noise caused by the contact failure which may result in the trouble therein.

BRIEF SUMMARY OF THE INVENTION

The present invention has been made in view of providing a separately-excited inverter circuit which makes it sure to protect the circuit upon the rise in the output voltage owing to the contact failure therein, and a liquid crystal television provided with the separately-excited inverter circuit.

The present invention provides a separately-excited inverter circuit that converts an direct current (DC) input voltage into an alternate current (AC) by a separately-excited switching circuit, comprising: a switching circuit that applies the AC to a primary coil of a transformer; a control circuit that performs a switch control of the switching circuit when receiving a command signal from a transmission line; an output voltage monitor circuit that allows a comparison circuit to compare an output voltage of the separately-excited inverter circuit with a predetermined voltage, and allows the comparison circuit to output a predetermined reference voltage when the output voltage is higher than the predetermined voltage; and a thyristor having a gate to which the reference voltage is input to cause the thyristor to flow a gate current turn on to impede the command signal on the transmission line to thereby stop the oscillation of the control circuit; the comparison circuit has a hysteresis loop that makes a time width of the reference voltage sufficient to turn the thyristor on. The output voltage monitor circuit outputs the reference voltage to make a time width sufficient to turn the thyristor ON using a hysteresis of the comparison circuit.

When the output voltage of the separately-excited inverter circuit exceeds the predetermined voltage, the output voltage monitor circuit outputs the reference voltage to turn the thyristor ON. The thyristor is connected to the transmission line of the command signal. When it is turned ON, the predetermined voltage is supplied to the transmission line so as to cause the control circuit to stop the switch control. Even if the duration of the output voltage to exceed the predetermined voltage is short, the output voltage monitor circuit outputs the reference voltage corresponding to at least the time to allow the thyristor to be turned ON using the hysteresis.

As the specific example of the thyristor, the thyristor may be formed of the SCS type. In the structure, a fixed bias is exerted to an anode so as to be preliminarily turned ON, an anode gate is connected to the transmission line of the command signal, a cathode gate has a capacitor connected to a ground, and a cathode is grounded. Upon an input of the reference voltage to the anode gate, the capacitor is charged from the anode, and a voltage capable of turning the cathode gate ON is applied to turn the thyristor ON entirely.

The thyristor does not have to be the single thyristor element. The thyristor may be formed as a thyristor circuit structured by combining a transistor of NPN type and a transistor of PNP type. The use of the thyristor circuit as the transistor may reduce the cost.

As the specific example of the output voltage monitor circuit, the output voltage monitor circuit may be a comparator which compares the predetermined voltage and the output voltage, and inputs a comparison result to an anode gate of the thyristor. When the output voltage is equal to or lower than the predetermined voltage, a high-level voltage signal is output as the reference voltage to keep an operation state of the thyristor OFF, and when the output voltage exceeds the predetermined voltage, a low-level voltage signal is output as the reference voltage to turn the thyristor ON.

As the structure for further stopping the separately-excited inverter circuit completely, the command signal may be output from a control unit. The control unit monitors a secondary voltage which generates in a secondary coil of the pressure-rising transformer, and stops outputting the command signal and inputting the DC voltage when a time taken for the secondary voltage to deviate from a predetermined range exceeds a predetermined time.

As the specific example of the liquid crystal television to which the separately-excited inverter circuit is applied, it displays an image on a screen by driving a liquid crystal panel based on a drive signal generated from an image signal extracted from a television broadcast signal upon reception thereof, the liquid crystal television, including: a separately-excited inverter circuit that converts a direct current (DC) input voltage into an alternate current (AC) by a separately-excited switching circuit, a power supply circuit that supplies the DC voltage to the separately-excited inverter circuit, a backlight that irradiates a light to a back surface of a liquid crystal panel by a luminescent lamp illuminated by the separately-excited inverter circuit, and a microcomputer that controls an oscillation of the separately-excited inverter circuit and an output of the power supply circuit, wherein: the separately-excited inverter circuit, comprises: a smoothing circuit that outputs a smooth voltage formed by removing a pulsation flow from the input DC voltage; a switching circuit that applies the AC to a primary coil of a transformer by a full-bridge circuit formed by connecting a first half-bridge unit with a second half-bridge unit, with each having one end to which the smooth voltage is input and another end grounded; a feedback circuit that outputs a feedback voltage obtained by dividing a voltage of the secondary coil of the transformer with a predetermined ratio; a driving circuit that performs a switching control of MOS-FETs, at a frequency of an input frequency signal, with the MOS-FETs forming the full-bridge circuit; a dimming control circuit that oscillates a predetermined frequency signal at a predetermined duty cycle under a phase-shift control between frequencies where the switching control of each of the MOS-FETs is performed to eliminate a vertical fluctuation of the feedback voltage so as to output to the driving circuit; an output voltage monitor circuit that includes: a comparator that compares the feedback voltage with a predetermined value, a diode having a cathode coupled with an output terminal of the comparator; a time constant circuit having a first resistance connects between a transmission line for transmitting the feedback voltage to the inverted input terminal and a ground, and a first capacitor connect between the transmission line and the ground, which forms a predetermined decay in the feedback voltage; a hysteresis resistance that couples the non-inverted input terminal to the output terminal to exert a hysteresis to the comparator; and a thyristor circuit that includes a first transistor of a PNP type, and a second transistor of NPN type, the microcomputer enables the dimming control circuit to oscillate by input of a high-level voltage signal to the dimming control circuit; the first transistor has a base coupled with both a collector of the second transistor and a transmission line, and the transmission line transmits a control signal to control the oscillation the dimming control circuit, the base of the first transistor coupled with an anode of the diode and a protecting terminal of the microcomputer, the first transistor has an emitter receiving the smooth voltage via a second resistance, and has a collector coupled with a base of the second transistor via a third resistance and grounded via a forth resistance, and the collector of the first transistor grounded via a second capacitor; the second transistor has an emitter grounded; the output voltage monitor circuit continues outputting a low-level voltage for a predetermined time sufficient to turn the thyristor circuit ON using the hysteresis when the feedback voltage becomes larger than the predetermined value; when the low-level voltage is input from the output voltage monitor circuit, the thyristor circuit turns the first transistor ON, and turns the second transistor ON, and the microcomputer grounds the transmission line of the high-level voltage signal and when it is determined that a voltage input to the protecting terminal is kept in the low-level state for a predetermined time, the microcomputer outputs the command signal to set the oscillation of the dimming control circuit to an OFF state, and stops outputting the DC voltage from the power supply circuit.

These and other features, aspects, and advantages of the invention will be apparent to those skilled in the art from the following detailed description of preferred non-limiting exemplary embodiments, taken together with the drawings and the claims that follow.

BRIEF DESCRIPTION OF THE DRAWINGS

It is to be understood that the drawings are to be used for the purposes of exemplary illustration only and not as a definition of the limits of the invention. Throughout the disclosure, the word "exemplary" is used exclusively to mean "serving as an example, instance, or illustration." Any embodiment described as "exemplary" is not necessarily to be construed as preferred or advantageous over other embodiments.

Referring to the drawings in which like reference character (s) present corresponding parts throughout.

DETAILED DESCRIPTION OF THE INVENTION

The detailed description set forth below in connection with the appended drawings is intended as a description of presently preferred embodiments of the invention and is not intended to represent the only forms in which the present invention may be constructed and or utilized.

The detailed description set forth below in connection with the appended drawings is intended as a description of presently preferred embodiments of the invention and is not intended to represent the only forms in which the present invention may be constructed and or utilized.

An embodiment of the present invention will be described in the following sections.

(1) Structure of liquid crystal television:

(2) Structure of inverter circuit:

(3) Structure of protection circuit:

(4) Outline:

(1) Structure of Liquid Crystal Television

Figure 1:
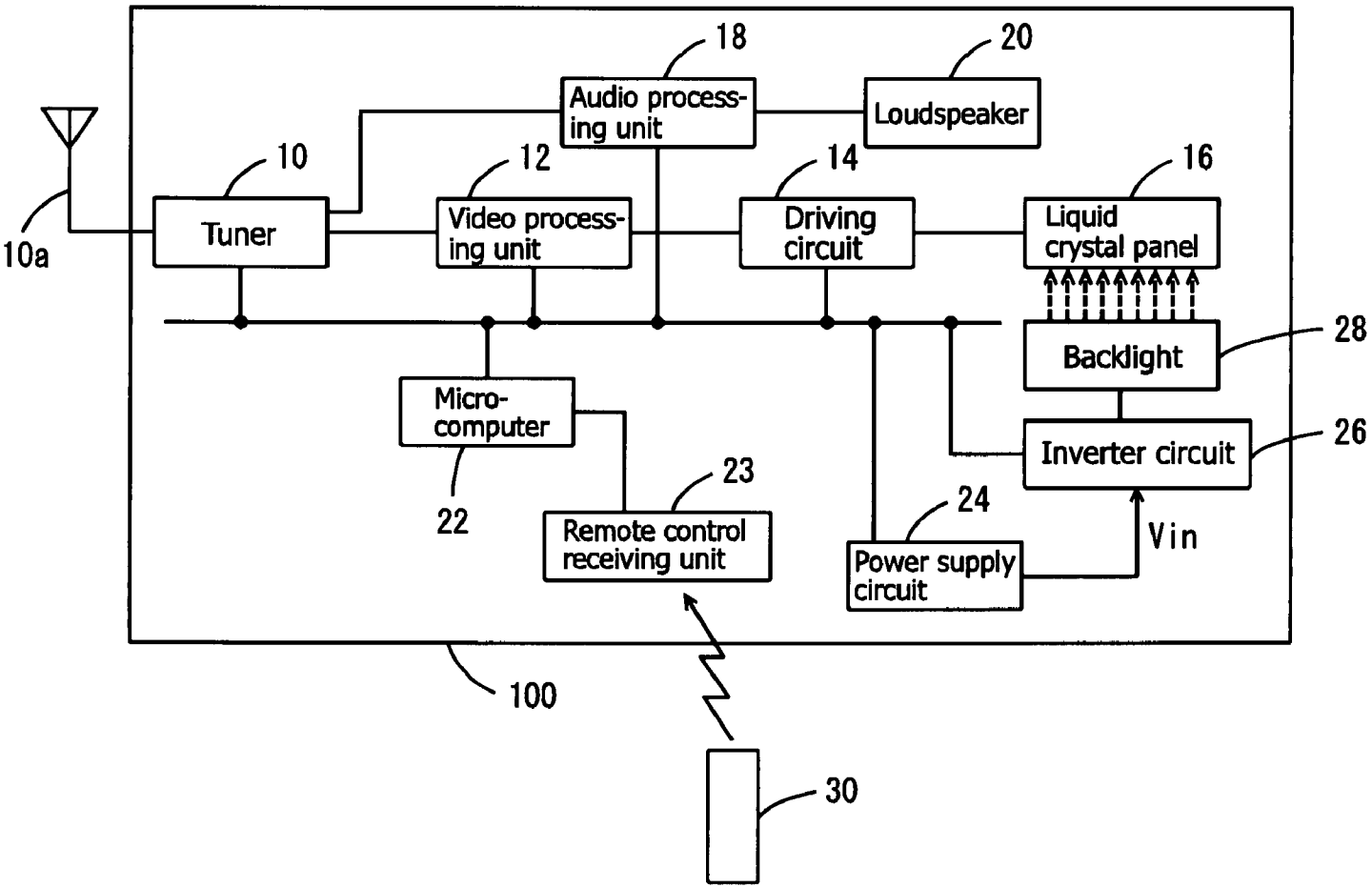
FIG. 1 is a block diagram of a liquid crystal television provided with an inverter circuit according to the present invention.

An embodiment of the present invention will be described referring to FIGS. 1 to 5. FIG. 1 is a block diagram showing the structure of a liquid crystal television 100 provided with an inverter circuit according to the present invention. The drawing shows the separately-excited inverter circuit. However, the inverter circuit may be formed as not only the separately-excited inverter circuit but also as the self-excited inverter circuit. The drawing omits the portions which are not directly related to the present invention. Although the liquid crystal television is described in the embodiment, any electric and electronic equipment may be employed so long as it allows the inverter circuit to be mounted thereon.

The liquid crystal television 100 includes a tuner 10 which receives a TV broadcast signal at the frequency of the selected station, a video processing unit 12 which subjects the image signal extracted from the TV broadcast signal to various image processings, a audio processing unit 18 which subjects the voice signal extracted from the TV broadcast signal to various voice processings so as to be output to a loudspeaker 20, a driving circuit 14 which generates a drive signal based on the image signal to drive a liquid crystal panel 16, a microcomputer 22 which controls the entire operations of the liquid crystal television 100, a remote control receiving unit 23 which receives a remote control signal from a remote control unit 30 to output the corresponding voltage signal to the microcomputer 22, a backlight 28 which irradiates the light to the back surface of the liquid crystal panel 16 using a plurality of fluorescent tubes, an inverter circuit 26 which supplies AC voltage to turn the backlight 28 ON, and a power supply circuit 24 which generates various voltages from the AC power source such as the commercial power source to supply the power source voltage to the respective sections of the liquid crystal television 100.

More specifically, the tuner 10 receives the TV broadcast signal at the predetermined frequency via an antenna 10*a* under the control of the microcomputer 22, extracts the image signal and the voice signal from the TV broadcast signal as the intermediate frequency signal while performing the predetermined signal amplifying process so as to output the image signal to the video processing unit 12 and the voice signal to the audio processing unit 18, respectively.

The video processing unit 12 digitizes the input image signal in accordance with the signal level, and performs matrix transformation based on the luminance signal and the color difference signal extracted from the image signal so as to generate RGB (red, green, blue) signal as the image data. The scaling of the RGB signal is performed corresponding to the pixel number (aspect ratio, m:n) of the liquid crystal panel 16 to generate the image data for a single screen to be displayed on the liquid crystal panel 16. The generated image data are output to the driving circuit 14. The driving circuit generates the drive signal in accordance with the input image data, and drives the respective display cells of the liquid crystal panel 16 so as to display the image on the screen.

The inverter circuit 26 receives the DC voltage from the power supply circuit 24 such that the high AC voltage at high frequency is generated from the DC voltage so as to be supplied to the backlight 28. The backlight 28 includes a plurality of the fluorescent tubes to serve as the light source which illuminates at the supplied AC voltage to irradiate the back surface of the liquid crystal panel 16.

The microcomputer 22 is electrically coupled with the respective components of the liquid crystal television 100. The CPU as the component inside the microcomputer 22 controls the liquid crystal television 100 entirely while using the RAM as the work area in accordance with the respective programs written in the ROM as the component in the microcomputer 22. The CPU, the ROM, and the RAM are not shown in the drawing. When the voltage signal for applying power to the liquid crystal television 100 from the remote control receiving unit 23 is input, the microcomputer 22 outputs the control voltage to start outputting the power source voltage of the power supply circuit 24, and oscillating the inverter circuit 26.

(2) Structure of Inverter Circuit

Figure 2:
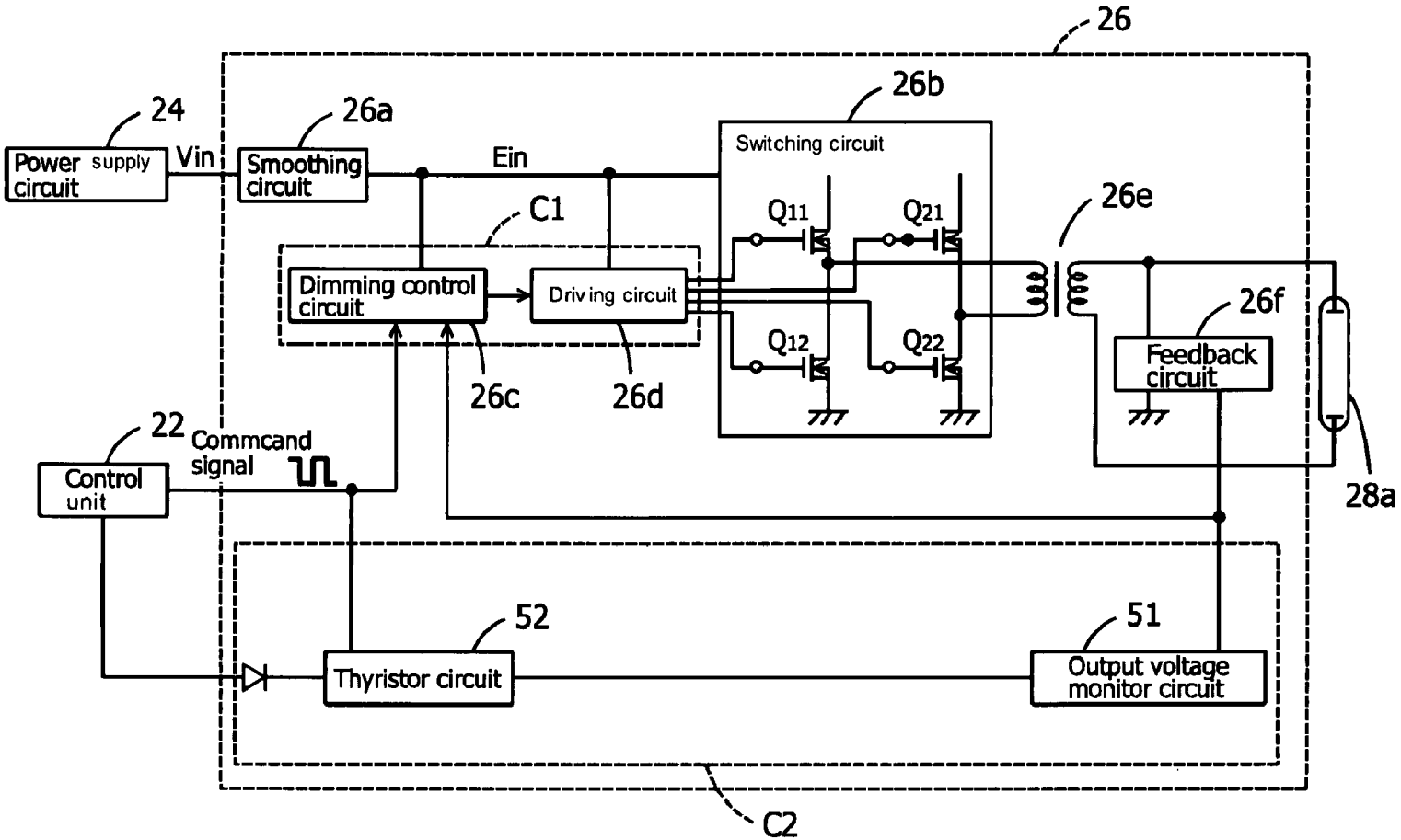
FIG. 2 is a block diagram showing the structure of the inverter circuit.
Figure 3:
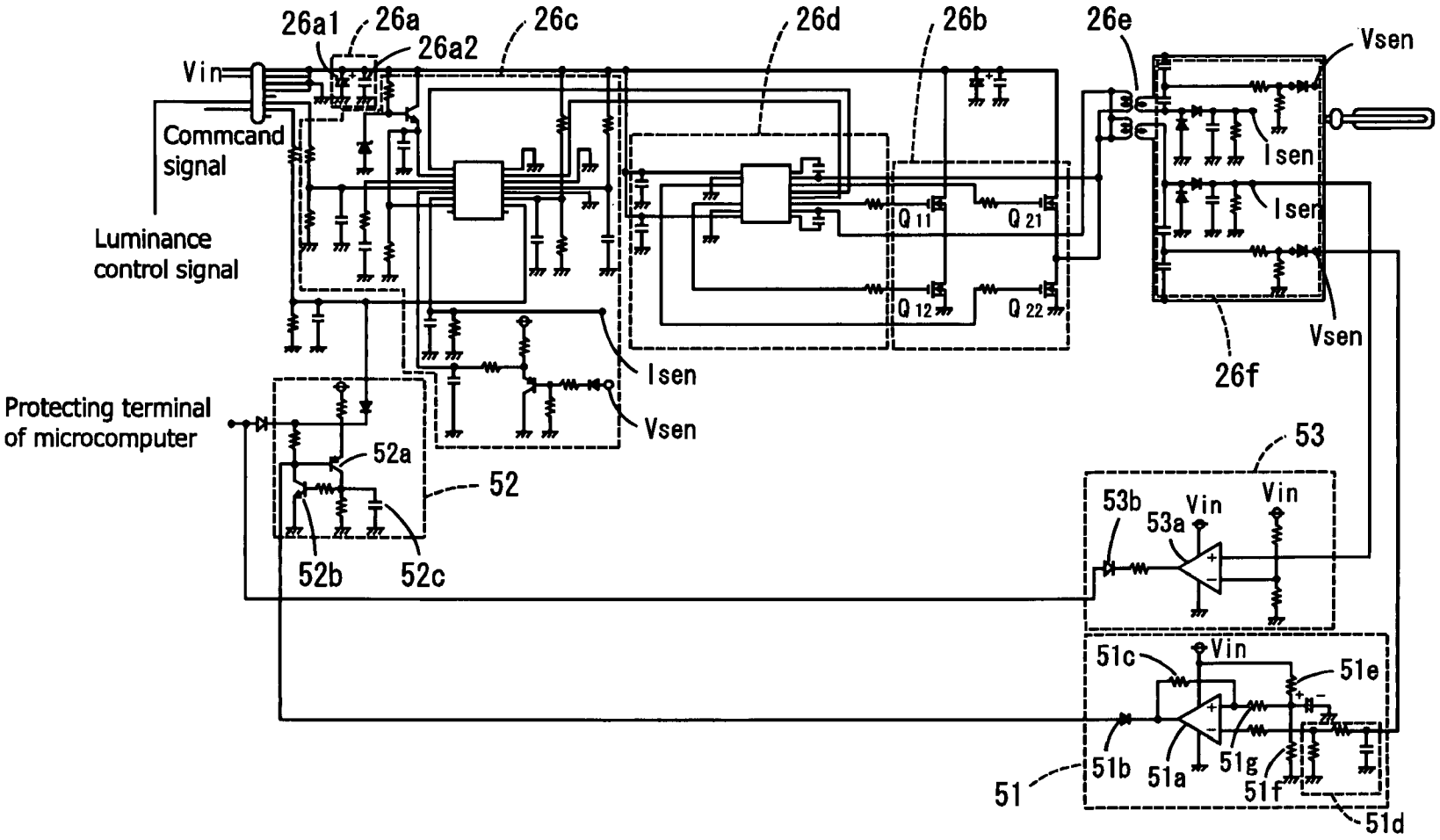
FIG. 3 is a circuit diagram of the inverter circuit according to a first embodiment of the present invention.
Figure 4:
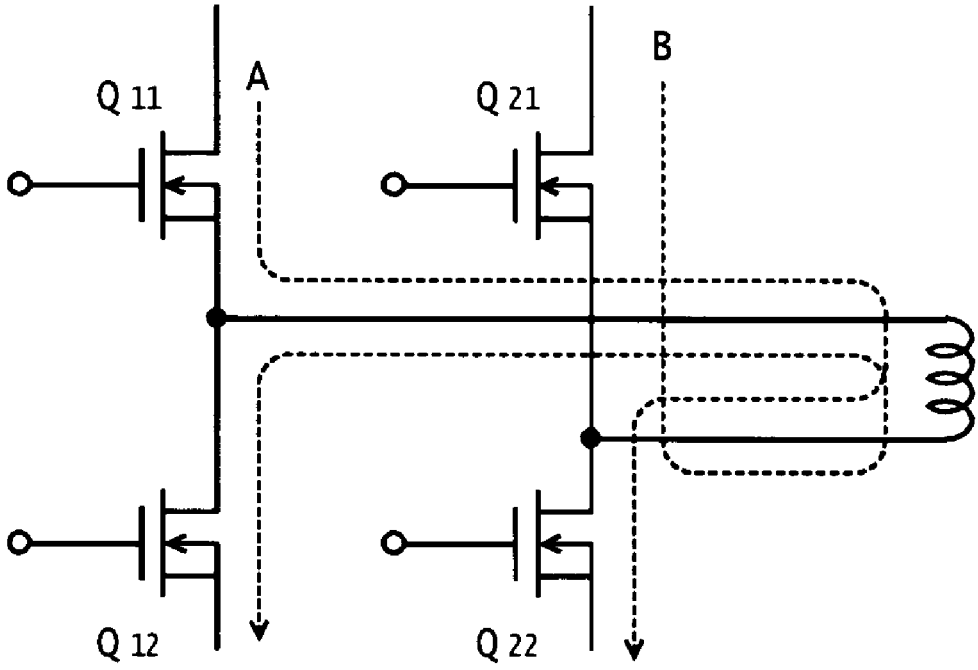
FIG. 4 is an explanatory view with respect to the operation of a full-bridge circuit.
Figure 5:
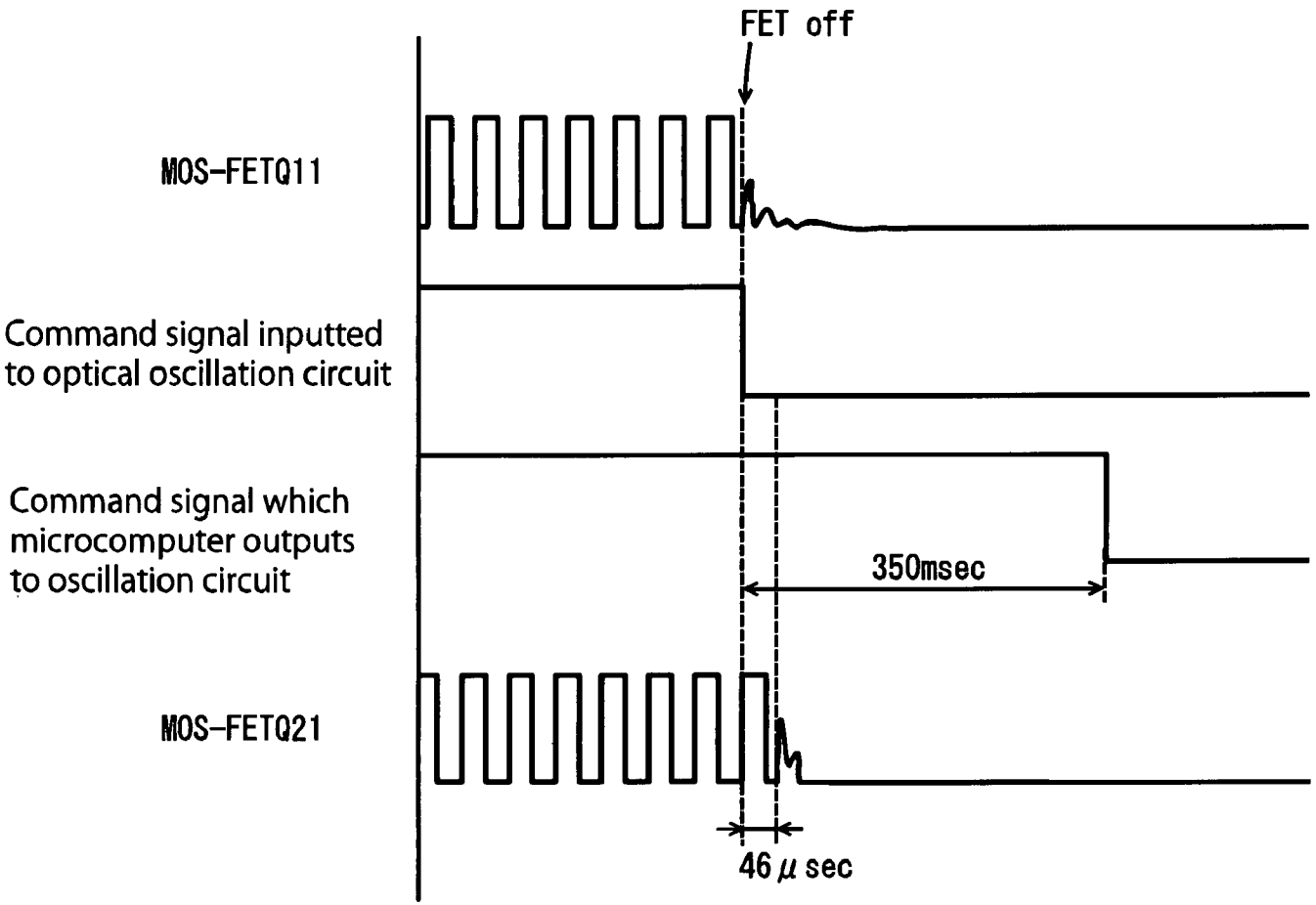
FIG. 5 is a view showing the phase-shift control.

The inverter circuit 26 will be described referring to FIGS. 2 to 5. FIG. 2 is a block diagram showing the structure of the inverter circuit 26. FIG. 3 is a circuit diagram of the inverter circuit according to the first embodiment of the present invention. FIG. 4 is an explanatory view showing the operation of the full-bridge circuit. FIG. 5 is an explanatory view showing the phase-shift control. The inverter circuit 26 is of separately-excited type, which generates the inverter voltage in the full-bridge circuit.

The inverter circuit 26 includes a smoothing circuit 26*a*, a switching circuit 26*b*, a dimming control circuit 26*c*, a driving circuit 26*d*, a pressure-rising transformer 26*e*, a feedback circuit 26*f*, an output voltage monitor circuit 51, and a thyristor circuit 52, which is driven by the DC voltage Vin input from the power supply circuit 24 to generate the voltage for illuminating the cold-cathode tube (luminescent lamp). Each of FIGS. 2 and 3 shows the single units of the switching circuit 26*b*, the pressure-rising transformer 26*e*, and the feedback circuit 26*f*, respectively. However, the number of those components may vary accompanied with the change in the number of the cold-cathode tubes 28*a*.

The DC voltage Vin is input to the switching circuit 26*b* via the smoothing circuit 26*a*, and is converted into the AC voltage at the desired frequency by switching the switching element, which is supplied to the cold-cathode tube via the pressure-rising transformer 26*e*. The control circuit C1 controls the switching operation of the switching circuit 26*b*. The specific circuit structure will be described hereinafter.

The inverter circuit 26 includes the smoothing circuit 26*a* formed of capacitors 26*a*1 and 26*a*2 to remove the pulsating flow from the input DC voltage Vin, which will be supplied to the switching circuit 26*b* at the rear stage as the smooth voltage Ein.

The switching circuit 26*b* is a separately-excited converter to which four MOS-FETs Q11, Q12, Q21, Q22 are full-bridge connected. The full-bridge connection is established by combining the half-bridge connection of the MOS-FETs Q11 and Q12 (first half-bridge connection) with the half-bridge connection of the MOS-FETs Q21 and Q22 (second half-bridge connection). In the embodiment, the MOS-FETs are used for forming the full-bridge circuit. However, other transistor element may also be employed.

The half-bridge connection of the MOS-FETs Q11 and Q12 may be formed by connecting the drain of the MOS-FET Q11 to the line of the smooth voltage Ein, connecting the source of the MOS-FET Q11 to the drain of the MOS-FET Q12, and grounding the source of the MOS-FET Q12. Likewise, the half-bridge connection of the MOS-FETs Q21 and Q22 may be formed by connecting the drain of the MOS-FET Q21 to the line of the smooth voltage Ein, connecting the source of the MOS-FET Q21 to the drain of the MOS-FET Q22, and grounding the source of the MOS-FET Q22.

The source-drain connection point of the MOS-FETs Q11 and Q12 (switching output point) is connected to one end of the primary coil of the pressure-rising transformer 26*e*. The other end of the primary coil of the pressure-rising transformer 26*e* is connected to the source-drain connection point (switching output point) of the MOS-FETs Q21 and Q22.

When a high level voltage signal (command signal) for commanding the oscillation, and a luminance control signal for commanding the duty at the predetermined cycle (for example, 200 MHz) are input from the microcomputer 22 (control unit), the dimming control circuit 26*c* oscillates the frequency signal corresponding to the desired switching frequency (for example, 46 kHz) to be output to the driving circuit 26*d*. In response to the luminance control signal, the frequency signal is oscillated during the duty ON period. Meanwhile, the frequency signal is not oscillated during the duty OFF period. For example, the duty becomes 100% when the display at the maximum luminance is selected. The dimming control circuit 26*c* at this time is expected to always oscillate the frequency signal. The driving circuit 26*d* outputs the switching drive signal to the MOS-FETs Q11, Q12, Q21 and Q22 in accordance with the oscillated frequency signal.

The driving circuit 26*d* controls such that the MOS-FETs Q11 and Q22 are turned ON/OFF at substantially the same timing, and the MOS-FETs Q12 and Q21 are turned ON/OFF at substantially the same timing. That is, the MOS-FETs Q1 and Q12, and Q21 and Q22 are turned ON/OFF alternately. The ON/OFF timing of the MOS-FETs Q11 and Q22 may be slightly shifted from that of the MOS-FETs Q12 and Q21 in the range of the half cycle of the switching frequency due to the phase-shift control to be described later.

When the MOS-FETs Q11 and Q22 are turned ON, the MOS-FETs Q12 and Q21 are turned OFF. The current flows on the path A shown in FIG. 4 in the order from the MOS-FET Q11, the primary coil of the pressure-rising transformer, the MOS-FET Q22, to the ground. Meanwhile, when the MOS-FETs Q12 and Q21 are turned ON, the MOS-FETs Q1 and Q22 are turned OFF. So the current flows on the path B shown in FIG. 4 in the order from the MOS-FET Q21, the primary coil of the pressure-rising transformer, the MOS-FET Q12 to the ground. The switching circuit 26*b* executes the switching control of full-bridge type to apply the AC to the primary coil of the pressure-rising transformer (alternately applying voltages each at the inverted phase).

The feedback circuit 26*f* outputs the feedback signal at the level corresponding to the fluctuation of the secondary voltage E2 (tube voltage) and the secondary current I2 (tube current) to the dimming control circuit 26*c*. The feedback circuit 26*f* for feedbacking the tube voltage employs the feedback voltage Vs derived from dividing the secondary voltage output from the secondary coil of the pressure-rising transformer 26*e* in the division capacitor so as to be lowered at the predetermined ratio as shown in FIG. 3. The feedback circuit 26*f* for feedbacking the tube current employs the feedback current Isen derived from rectifying the secondary current of the pressure-rising transformer 26*e* in the diode to remove the pulsating flow by the capacitor.

The dimming control circuit 26*c* executes the phase-shift control based on the feedback signal as shown in FIG. 5 to make the ON duty of the switching circuit 26*b* variable. More specifically, the phase difference is generated in the switching frequency between the MOS-FETs Q11 and Q12, and in the switching frequency between the MOS-FETs Q21 and Q22. For example, when the secondary current I2 or the secondary voltage E2 is lowered, the dimming control circuit 26*c* increases the ON-duty ratio of the switching circuit 26*b*. That is, the driving circuit 26*d* controls such that the time for simultaneously turning the MOS-FETs QI1 and Q22 ON, and the time for simultaneously turning the MOS-FETs Q21 and Q12 ON become long, respectively. As a result, the duty of the voltage transmitted to the secondary side is varied such that the constant current (constant voltage) control for eliminating the vertical fluctuation in the feedback voltage is executed.

The feedback voltage Vsen output from the feedback circuit 26*f* is output to the microcomputer 22. The microcomputer 22 receives the input feedback voltage Vsen at a predetermined time interval to determine whether or not the value of the feedback voltage Vsen is in the predetermined range. When the feedback voltage Vsen deviates from the predetermined range a plurality of times successively, it is determined that the secondary voltage E2 has the abnormality. The operation of the inverter circuit is then interrupted. The aforementioned condition is set for the purpose of avoiding the malfunction caused by the momentary vertical fluctuation in the voltage such as noise. More specifically, the voltage of the command signal output from the microcomputer 22 to the dimming control circuit 26*c* is lowered from the high level to the low level to stop oscillating the dimming control circuit 26*c*. Simultaneously with the aforementioned operation, the microcomputer 22 may allow the power supply circuit 24 to stop outputting the power.

(3) Structure of Protection Circuit

The output voltage monitor circuit 51 and the thyristor circuit 52 which constitute the protection circuit C2 for stopping oscillating the inverter circuit 26 by detecting the noise from the output voltage of the feedback circuit 26*f* will be described in detail referring to FIG. 3. The noise voltage superimposed to the secondary voltage resulting from the contact failure between the terminal of the inverter circuit 26 such as the pressure-rising transformer and the substrate is set to the value equal to or higher than Vn, and the secondary voltage output when the inverter circuit 26 performs the normal oscillation is set to the value Vo (Vn>Vo). The voltage equal to or higher than the noise voltage Vn corresponds to the overvoltage.

The output voltage monitor circuit 51 is mainly formed of a comparator 51*a* as a comparison circuit for performing the comparison between the output voltage of the inverter circuit 26 and the predetermined voltage, and a diode 51*b* having the cathode connected to the output terminal of the comparator. The voltage corresponding to the feedback voltage Vsen of the feedback circuit 26*f* is input to the inverted input terminal in the comparator 51*a*, and the voltage Vip formed by dividing the DC voltage Vin at the predetermined ratio is input to the non-inverted input terminal More specifically, two resistances 51*e* and 51*f* are connected in series between the DC voltage Vin and the ground such that the region between the two resistances is connected to the non-inverted input terminal via a resistance 51*g*. That is, the voltage between the resistances 51*e* and 51*f* which has been reduced by the resistance is input to the non-inverted input terminal.

The voltage corresponding to the feedback voltage Vsen is input to the inverted input terminal as the voltage Vim. The line on which the feedback voltage Vsen is transmitted to the inverted input terminal is connected to the first resistance and the first capacitor which are grounded. The first capacitor and the first resistance constitute a predetermined CR time constant circuit 51*d* so as to drop the voltage transmitted on the transmission line at the feedback voltage Vsen with the predetermined time constant. Irrespective of the sharp drop (decay) in the feedback voltage Vsen, the voltage Vim input to the inverted input terminal of the comparator 51*a* is allowed to have the time to drop corresponding to the predetermined discharging curve.

The relationship of Vim<Vip is set to be established when the secondary voltage E2 is the normal voltage Vo. Meanwhile, the relationship of Vim>Vip is set to be established when the secondary voltage E2 becomes the noise voltage Vn. The comparator 51a outputs the high-level voltage upon input of the voltage set to Vo to the inverted input terminal, and outputs the low-level voltage upon input of the voltage set to the noise voltage Vn to the inverted input terminal.

When the comparator 51*a* outputs the high-level voltage, the output of the output voltage monitor circuit 51 becomes the inverted bias with respect to the diode 51*b*. Accordingly, the output voltage is not input to the thyristor circuit 52. Meanwhile, when the comparator 51*a* outputs the low-level voltage, the output becomes the forward bias with respect to the diode 51*b*. Accordingly, the output voltage is input to the thyristor circuit 52. The low-level voltage output from the comparator 51*a* corresponds to the predetermined reference signal.

In the comparator 51*a*, the hysteresis resistance 51*c* which connects the non-inverted input terminal to the output terminal forms the hysteresis loop. The invalid zone to which the hysteresis is exerted is defined by the resistance value of the hysteresis resistance 51*c*. That is, as the signal with the predetermined drop period is input to the comparator 51*a* by the CR time constant circuit 51*d*, the difference voltage of the comparator 51*a* becomes negative to bring the output voltage into the low level. Then the low level voltage will be continuously output for a predetermined time after the next cycle where the difference voltage becomes positive. Even if the time width of the noise voltage Vn superimposed to the secondary voltage E2 of the feedback circuit 26*f* is insufficient for turning the thyristor circuit 52 ON, the reference voltage output from the comparator 51*a* may have the time width sufficient for turning the thyristor circuit 52 ON. In the aforementioned description, the noise is superimposed to the secondary voltage E2 to show that the detection may be performed in spite of the rise in the voltage for the short period. However, the output voltage monitor circuit 51 is capable of monitoring not only the noise but also the general rise in the output voltage.

The thyristor circuit 52 will be described. The thyristor circuit 52 of SCS (Silicon Controlled Switch) type is formed by combining the NPN type transistor 52*b* with the PNP type transistor 52*a*. The single unit of the thyristor element may be used as the thyristor circuit 52. The structure may be selected in consideration with the balance between the substrate space and the cost. The thyristor circuit 52 is not limited to the SCS type, but may be structured as various types of the thyristor or equivalent circuit such as the SCR (Silicon Controlled Rectifier) type and the TRIAC (Bidirectional Triode Thyristor).

The transistor 52*a* has its base connected to the collector of the transistor 52*b*, and the anode of the diode 51*b* in the output voltage monitor circuit 51. The emitter receives the input of Vin via the second resistance, and the collector is grounded via the forth resistance. The Vin input to the emitter of the transistor 52*a* corresponds to the fixed bias. When the low-level voltage signal of the output voltage monitor circuit 51 is input to the base of the transistor 52*a*, the transistor 52*a* is turned ON, and the thyristor circuit 52 is also turned ON.

The collector of the transistor 52*a* is also connected to the base of the transistor 52*b* via the third resistance. The transistor 52*b* has the emitter grounded. The collector of the transistor 52*a* is further grounded via the capacitor 52*c* (second capacitor). As the capacitor 52*c* is grounded to the base of the transistor 52*b* via the third resistance, when the transistor 52*a* is turned ON, the capacitor 52*c* is charged such that the predetermined voltage sufficient to turn the transistor 52*b* ON is applied to the base thereof.

The base of the transistor 52*a* is connected to the transmission line on which the voltage signal from the microcomputer 22 for commanding the dimming control circuit 26*c* to oscillate is transmitted via the resistance and the diode connected in series. The diode is connected so as to be directed forward from the transmission line to the base of the transistor 52*a*.

In the thyristor circuit 52, the collector terminal of the transistor 52*a* corresponds to the cathode gate, and the emitter terminal of the transistor 52*b* corresponds to the cathode. The emitter terminal of the transistor 52*a* corresponds to the anode, and the base terminal of the transistor 52*a* and the collector terminal of the transistor 52*b* connected thereto correspond to the anode gates. The thyristor circuit according to the present invention may be formed as the single unit of the thyristor element based on the aforementioned correlations.

In the aforementioned structure, the low-level voltage output from the output voltage monitor circuit 51 is input to the base of the transistor 52*a*. Then the transistor 52*b* is turned ON, and the transistor 52*a* is further turned ON as well. The transmission line of the high-level voltage signal for commanding the dimming control circuit 26*c* to oscillate is grounded via the transistor 52*b*. The dimming control circuit 26*c* stops oscillating. As a result, the driving circuit 26*d* stops performing the switching control of the switching circuit 26*b*.

The base terminal of the transistor 52*a* is connected to the protecting terminal of the microcomputer 22 via the resistance and the diode connected in series. The diode is connected in the forward direction from the microcomputer 22 to the anode gate of the thyristor circuit 52. Accordingly, when the low-level voltage signal is input from the output voltage monitor circuit 51 to the thyristor circuit 52, it is also input to the protecting terminal of the microcomputer 22.

The microcomputer 22 obtains the voltage of the protecting terminal at predetermined time intervals. When the voltage drop of the protecting terminal is consecutively detected a plurality of times, it is determined that abnormality occurs, and the output of the command signal is stopped. The microcomputer 22 stops supplying the power source to the power supply circuit 24 such that the supply of the DC voltage Vin from the power supply circuit 24 to the inverter circuit 26 is stopped. When the noise occurs in the secondary voltage E2, the protecting circuit C2 stops oscillating the inverter circuit 26 to completely stop the drive voltage of the inverter circuit 26 while preventing worsening of the failure. Then the user or the inspector may be informed of the abnormality in the inverter circuit, thus suppressing the repair time and the cost to a minimum.

An output current monitor circuit 53 for monitoring the feedback voltage Isen corresponding to the secondary current I2 of the pressure-rising transformer 26*e* may be provided to form the structure which allows the microcomputer 22 to monitor the output of the output current monitor circuit 53. For example, the output current monitor circuit 53 includes a comparator 53*a*, and a diode 53*b* connected to the output terminal of the comparator 53*a* having the cathode directed thereto. The anode of the diode 53*b* is connected to the protecting terminal of the microcomputer 22. The comparator 53*a* divides the DC voltage Vin with the predetermined division ratio such that the voltage at the divided point is input to an inverted input terminal, and the feedback voltage Isen is input to a non-inverted input terminal.

The voltage input to the inverted input terminal of the comparator 53*a* is lower than the feedback voltage Isen when the secondary current I2 is in the normal state, and is higher than the feedback voltage Isen when the secondary current I2 becomes lower than the predetermined voltage. When the feedback voltage Isen is higher than the predetermined voltage, the comparator 53*a* outputs the high-level voltage signal. When the feedback voltage Isen becomes lower than the predetermined voltage, the comparator 53*a* outputs the low-level voltage signal. The microcomputer 22 determines with respect to the voltage drop in the aforementioned protecting terminal based on the output of the comparator 53*a*.

The operation of the above-structured embodiment will be described hereinafter.

When the terminal of the pressure-rising transformer 26*e* is appropriately connected to the substrate, the secondary side of the pressure-rising transformer 26*e* outputs the voltage Vo which contains no noise. Accordingly, as the output voltage monitor circuit 51 detects no noise, and the comparator 51*a* outputs the high level voltage signal. So the output voltage monitor circuit 51 does not output the reference voltage to the thyristor circuit 52. When the microcomputer 22 outputs the command signal to be input to the dimming control circuit 26*c*, the MOS-FETs Q11 and Q21 are alternately turned ON/OFF with repetition under the control of the driving circuit 26*d*. The secondary voltage E2 is continuously output.

When the tunnel solder or tracking occurs at the solder portion between the terminal of the pressure-rising transformer 26*e* and the substrate to cause the noise voltage Vn in the secondary voltage E2, the output voltage monitor circuit 51 detects the noise. In the case where the time width of the noise to be detected is short, and the time for inverting the difference voltage of the comparator 51*a* is short, the time for outputting the low-level voltage signal from the comparator 51*a* becomes equal to or longer than the predetermined period by the CR time constant circuit 51*d* and the hysteresis resistance 51*c*. In other words, the low-level voltage is applied to the thyristor circuit 52 for the period corresponding to the one sufficient to turn the circuit ON.

When the thyristor circuit 52 is turned ON, the line for transmitting the command signal to the dimming control circuit 26*c* is drawn to the low level to stop inputting the command signal to the dimming control circuit 26*c*. The oscillation of the dimming control circuit 26*c* may be stopped at substantially the same timing as generation of the noise, and the AC input from the switching circuit 26*b* to the pressure-rising transformer 26*e* is also stopped. This makes it possible to stop supplying the voltage applied to the pressure-rising transformer 26*e* for several tens micro seconds from generation of the tunnel solder or tracking in the terminal of the pressure-rising transformer 26*e*.

When the low-level voltage signal output from the output voltage monitor circuit 51 is detected by the protecting terminal of the microcomputer 22 a plurality of times at predetermined time intervals, the microcomputer 22 determines that abnormality has occurred in the secondary side of the inverter circuit 26, and stops operating the inverter circuit 26 and the power supply circuit 24 after several hundreds milliseconds.

(4) Outline

The inverter circuit includes the switching circuit 26*b* which applies the AC to the primary coil of the pressure-rising transformer 26*e*, the control circuit C1 which starts the switch control of the switching circuit 26*b* upon input of the command signal to set the oscillation ON from the transmission line of the command signal for commanding to set the oscillation ON/OFF, the output voltage monitor circuit 51 which outputs the reference voltage when the output voltage is higher than the predetermined voltage based on the comparison between the output voltage of the separately-excited inverter circuit and the reference signal by the comparator 51*a*, and the thyristor circuit 52 which is turned ON to stop the switch control of the control circuit C1 upon input of the reference voltage to the gate by setting the transmission line on which the command signal to command to set the oscillation ON/OFF is transmitted to OFF state. The output voltage monitor circuit 51 outputs the reference voltage so as to realize the time width sufficient to turn the thyristor circuit 52 ON using the hysteresis of the comparator 51*a*. The separately-excited inverter circuit makes it sure to perform the protection upon detection of the rise in the output voltage caused by the contact failure.

It is to be understood that the present invention is not limited to the embodiment as described above, and that variances described below shall be considered as embodiments disclosed in the present invention.

A variance in which any of the members disclosed in one of the embodiments are appropriately combined with any of those disclosed in the other embodiments and exchangeable with the members.

A variance in which the members and structures disclosed in the embodiments are appropriately exchanged with those disclosed in related arts but not disclosed in the embodiments or appropriately combined with one another.

A variance in which the members and structures disclosed in the embodiments are appropriately exchanged with those thought to be substitutes by a person with ordinary skill in the art but not disclosed in the embodiments, and appropriately combined with one another.

While the invention has been particularly shown and described with respect to a preferred embodiment thereof, it should be understood by those skilled in the art that the foregoing and other changes in form and detail may be made therein without departing from the spirit and scope of the invention as defined in the appended claims.

For purposes of illustration, programs and other executable program components are illustrated herein as discrete blocks, although it is recognized that such programs and components may reside at various times in different storage components, and are executed by the data processor(s) of the computers.

It should further be noted that throughout the entire disclosure, the labels such as left, right, front, back, top, bottom, forward, reverse, clockwise, counter clockwise, up, down, or other similar terms such as upper, lower, aft, fore, vertical, horizontal, proximal, distal, etc. have been used for convenience purposes only and are not intended to imply any particular fixed direction or orientation. Instead, they are used to reflect relative locations and/or directions/orientations between various portions of an object.

In addition, reference to "first," "second," "third," and etc. members throughout the disclosure (and in particular, claims) is not used to show a serial or numerical limitation but instead is used to distinguish or identify the various members of the group.

What is claimed is:

1. A separately-excited inverter circuit, comprising:

a transformer having a primary coil and a secondary coil;

a switching circuit that is coupled with the primary coil of the transformer, converts a direct current (DC) input voltage into an alternate current (AC) output voltage, and applies the AC output voltage to the primary coil of the transformer;

a control circuit that performs a switch control of the switching circuit when receiving a command signal from a command signal transmission line;

a feedback circuit that is coupled with a feedback voltage transmission line for transmitting a direct current feedback voltage and converts an alternate current voltage of the secondary coil of the transformer into the feedback voltage;

an output voltage monitor circuit that is coupled with the feedback voltage transmission line; and a thyristor that is coupled with the command signal transmission line;

wherein the output voltage monitor circuit has a comparator, a CR time constant circuit and a hysteresis resistance;

the comparator has a non-inverted input terminal, an inverted input terminal and an output terminal;

a divided voltage of a DC input voltage is input to the non-inverted input terminal;

a voltage corresponding to the feedback voltage on the feedback voltage transmission line is input to the inverted input terminal;

the output terminal of the comparator outputs a reference voltage to a gate of the thyristor when the feedback voltage is higher than a predetermined voltage;

the CR time constant circuit has a resistance connected between the feedback voltage transmission line and a ground;

the CR time constant circuit has a capacitor connected between the feedback voltage transmission line and the ground;

the CR time constant circuit forms a predetermined decay in the feedback voltage;

the hysteresis resistance is connected between the output terminal of the comparator and the non-inverted input terminal of the comparator;

when the reference voltage from the output terminal of the comparator is input to the gate of the thyristor, a gate current flows through the thyristor, and the thyristor turns on and impedes the command signal on the command signal transmission line to thereby stop the oscillation of the control circuit; and the hysteresis resistance exerts a hysteresis to the comparator to make a time width of the reference voltage sufficient to turn the thyristor on.

2. The separately-excited inverter circuit according to claim 1, wherein:

the thyristor is of silicon controlled switch (SCS) type;

a fixed bias is exerted to an anode of the thyristor so as to be preliminarily turned ON, an anode gate of the thyristor is connected to the transmission line, a cathode gate of the thyristor has a second capacitor connected to a ground, and a cathode of the thyristor is grounded; and upon an input of the reference voltage to the anode gate, the second capacitor is charged from the anode, and a voltage capable of turning the cathode gate ON is applied to turn the thyristor ON.

3. The separately-excited inverter circuit according to claim 1, wherein the thyristor is formed as a thyristor circuit structured by combining a transistor of NPN type and a transistor of PNP type.

4. The separately-excited inverter circuit according to claim 1, wherein:

the command signal is output from a microcomputer; and the microcomputer monitors a secondary voltage that generates in a secondary coil of the transformer, and stops outputting the command signal and inputting the DC voltage when a time taken for the secondary voltage to deviate from a predetermined range exceeds a predetermined time.

5. A liquid crystal television that displays an image on a screen by driving a liquid crystal panel based on a drive signal generated from an image signal extracted from a television broadcast signal upon reception thereof, the liquid crystal television, comprising:

a separately-excited inverter circuit;

a power supply circuit that supplies a direct current (DC) voltage to the separately-excited inverter circuit;

a backlight that irradiates a light to a back surface of a liquid crystal panel by a luminescent lamp illuminated by the separately-excited inverter circuit; and a microcomputer that controls an oscillation of the separately-excited inverter circuit and an output of the DC voltage of the power supply circuit;

wherein:

the separately-excited inverter circuit includes:

a transformer having a primary coil and a secondary coil;

a smoothing circuit that outputs a smooth voltage formed by removing a pulsation flow from the DC voltage supplied by the power supply circuit;

a switching circuit that is coupled with the primary coil of the transformer, converts the smooth voltage into an alternate current (AC) output voltage, and applies the AC output voltage to the primary coil of the transformer;

a feedback circuit that is coupled with a feedback voltage transmission line for transmitting a direct current feedback voltage and converts an AC voltage of the secondary coil of the transformer into the feedback voltage obtained by dividing a voltage of the secondary coil of the transformer with a predetermined ratio;

a driving circuit that performs a switching control of MOS-FETs, at a frequency of an input frequency signal, with the MOS-FETs forming the full-bridge circuit;

a dimming control circuit that oscillates a predetermined frequency signal at a predetermined duty cycle under a phase-shift control between frequencies where the switching control of each of the MOS-FETs is performed to eliminate a vertical fluctuation of the feedback voltage so as to output to the driving circuit;

an output voltage monitor circuit that includes a comparator, a diode, a CR time constant circuit and a hysteresis resistance; and a thyristor circuit that includes a first transistor of a PNP type and a second transistor of NPN type;

the comparator has a non-inverted input terminal, an inverted input terminal and an output terminal;

a divided voltage of a DC input voltage is input to the non-inverted input terminal;

a voltage corresponding to the feedback voltage on the feedback voltage transmission line is input to the inverted input terminal;

the output terminal of the comparator outputs a reference voltage to the thyristor when the feedback voltage is higher than a predetermined voltage;

diode has a cathode coupled with an output terminal of the comparator;

the CR time constant circuit has a first resistance connected between feedback voltage transmission line and a ground;

the CR time constant circuit has a first capacitor connected between the feedback voltage transmission line and the ground;

the CR time constant circuit forms a predetermined decay in the feedback voltage;

the hysteresis resistance is connected between the output terminal of the comparator and the non-inverted input terminal of the comparator;

the microcomputer outputs a high-level voltage signal as the command signal;

the first transistor has a base coupled with both a collector of the second transistor and the command signal transmission line;

the base of the first transistor coupled with an anode of the diode and a protecting terminal of the microcomputer;

the first transistor has an emitter receiving the smooth voltage via a second resistance, and has a collector coupled with a base of the second transistor via a third resistance and grounded via a forth resistance, and the collector of the first transistor grounded via a second capacitor;

the second transistor has an emitter grounded;

when the reference voltage from the output terminal of the comparator is input to the thyristor, the first transistor and the second transistor turn on, the dimming control circuit stop oscillating, and the driving circuit stop controlling the switching circuit; and when it is determined that a voltage input to the protecting terminal is kept in the low-level state for a predetermined time, the microcomputer outputs a signal to set the oscillation of the dimming control circuit to an OFF state, and stops outputting the DC voltage from the power supply circuit.

* * * * *